US005907757A

United States Patent [19]

Suzuki

[11] Patent Number: 5,907,757

[45] Date of Patent: May 25, 1999

[54] TONER SUPPLY DEVICE FOR USE IN IMAGE FORMING APPARATUS

[75] Inventor: Tsuyoshi Suzuki, Owariasahi, Japan

[73] Assignee: Brother Kogyo Kabushiki Kaisha, Nagoya, Japan

[21] Appl. No.: 08/863,954

[22] Filed: May 27, 1997

[30] Foreign Application Priority Data

May 27, 1996 [JP] Japan ..... 8-131675

[51] Int. Cl.[6] ..... G03G 15/08

[52] U.S. Cl. ..... 399/281; 395/284

[58] Field of Search ..... 399/272, 274, 399/275, 281, 284

[56] References Cited

U.S. PATENT DOCUMENTS

| | | | |
|---|---|---|---|
| 4,760,422 | 7/1988 | Seimiya et al. . | |
| 5,338,895 | 8/1994 | Ikegawa et al. | 399/280 |
| 5,373,353 | 12/1994 | Fukasawa | 399/284 |
| 5,819,145 | 10/1998 | Tanaka et al. | 399/274 |

*Primary Examiner*—Joan Pendegrass
*Attorney, Agent, or Firm*—Oliff & Berridge, PLC

[57] ABSTRACT

A toner supply device for use in an image forming apparatus is constructed such that a length of the extruding portion 24A of the L-shaped blade 24 is determined to 2 mm or less and a distance of the gap Y is determined to 3 mm or more, the gap Y being formed between the contact portion 19A and an intersection point where an imaginary straight line passing a rotating center of the toner supply roller 20 and the contact portion 19A intersects the surface of the toner supply roller 20 namely, between the lower surface of the extruding portion 24A and the outer peripheral surface of the toner supply roller 20. With this structure, a toner supply path G is formed linearly around the toner supply roller 20 and the developing roller 19 without making a large detour in the developing roller 19 side, so that the flow of toner can be made smooth in the toner supply path G, preventing toner clogging therein. Accordingly, toner can smoothly be supplied from the toner supply roller 20 to the developing roller 19 and the resultant image excellent in quality can be obtained for a long period.

6 Claims, 6 Drawing Sheets

PRIOR ART

TONER SUPPLY DEVICE FOR USE IN IMAGE FORMING APPARATUS

BACKGROUND OF THE INVENTION

1. Field of the Invention

The present invention relates to a toner supply device for use in an image forming apparatus such as a laser printer, etc., for developing an electrostatic latent image by supplying toner to the electrostatic latent image formed on an outer peripheral surface of a photosensitive drum and transferring the image developed on the surface of the photosensitive drum onto a sheet, and particularly to a toner supply device for use in an image forming apparatus, capable of smoothly supplying toner supplied from toner storing part through a toner supply roller to a developing roller without causing clogging with toner in a toner supply path formed around the toner supply roller and the developing roller resulting in obtaining the image with excellent quality for a long period.

2. Description of Related Art

Regarding conventional toner supply devices for use in image forming apparatuses such as laser printers, etc., there have been proposed various types of the devices. In general, such a toner supply device is constructed of a toner storing member including a toner cartridge, a toner supply roller for supplying toner from the toner storing member, and a developing roller for developing an electrostatic latent image on a photosensitive drum by supplying the toner provided from the toner supply roller onto the image. One embodiment of the toner supply device will be explained with reference to FIG. 7. FIG. 7 is an explanatory view showing schematically a main construction of the toner supply device in the prior art.

In FIG. 7, the toner supply device has a toner cartridge 100 which accommodates therein toner and is provided with an opening for toner supply at an almost center in its width direction. This toner cartridge 100 is provided therein with an agitator 103 for agitating toner to supply same into a developing chamber 102 side through a toner supply port 101. A frame F of the developing unit is provided with an opening for toner supply positioned corresponding to the toner supply opening of the toner cartridge 100. Those openings of the toner cartridge 100 and the frame F form the toner supply port 101 in combination with each other.

Below inside the developing chamber 102 constructed of an upper frame F1 and a lower frame F2 of the frame F, a toner supply roller 104 is arranged rotatably in a lower frame F2 side, for supplying the toner supplied through the toner supply port 101 to a developing roller 105.

On an internal wall of the upper frame F1, above the developing roller 105, a blade 107 is fixedly secured with a fixing element 106, whereby regulating a thickness of toner layer formed on the surface of the developing roller 105. This developing roller 105 is also arranged in contact with a photosensitive drum 108. On the peripheral surface of the photosensitive drum 108 is formed an electrostatic latent image by an image exposure device not shown which performs a scanning operation with a laser beam in accordance with image data. The developing roller 105 supplies toner on the electrostatic latent image formed on the peripheral surface of the photosensitive drum 108 to develop the image. The image developed on the surface of the photosensitive drum 108 is then transferred onto a sheet fed from a sheet feeder not shown, forming a resultant image (a visual image) on the sheet.

In the toner supply device in the prior art, meanwhile, a toner supply path 109 indicated by an arrow E in FIG. 7 is formed around the toner supply roller 104 and the developing roller 105, along which the toner supplied from the toner cartridge 100 through the toner supply port 101 is allowed to flow into the developing chamber 102. In detail the toner supply path 109 is formed so as to extend from the toner supply port 101, above the toner supply roller 104, and make a detour along the lower surface of an extruding portion 107A of the blade 107, and finally upward in the developing chamber 102. The extruding portion 107A is formed extruding from a contact portion of the blade 107 in contact with an outer surface of the developing roller 105.

Here, to well supply toner along the toner supply path 109, it is important to make a determination as to the length of the extruding portion 107A of the blade 107, which is the length from the contact portion to the tip end portion of the extruding portion 107A, and also the gap formed between the lower surface of the extruding portion 107A and an outer peripheral surface of the toner supply roller 104. Specifically, if the length of the extruding portion 107A is too long, it allows the toner supply path 109 to make a detour largely toward the developing roller 105, preventing a smooth flow of the toner, and thereby causing clogging in the toner supply path 109 with toner. If the gap between the lower surface of the extruding portion 107A and the toner supply roller 104 is too small, similarly, it prevents the toner from smoothly flowing along the toner supply path 109, causing clogging therein with toner.

Under such a situation, most of conventional toner supply devices are constructed to have the extruding portion 107A determined to 2 mm or more in length and the gap determined to 3 mm or less between the lower surface of the extruding portion 107A and the toner supply roller 104. Accordingly, it is extremely likely to prevent the toner from smoothly flowing on the toner supply path 109 formed around the toner supply roller 104 and the developing roller 105, and thereby cause clogging in the toner supply path 109 with the toner. Due to such the toner clogging, it becomes hard to smoothly supply toner from the toner supply roller to the developing roller, which would prevent the forming for a long time of the resulting image excellent in quality.

SUMMARY OF THE INVENTION

The present invention has been made in view of the above circumstances and has an object to overcome the above problems and to provide a toner supply device in claim 1 for use in an image forming apparatus capable of smoothly supplying toner from the toner supply roller to a developing roller without causing toner clogging in a toner supply path formed around a toner supply roller and a developing roller in supplying the toner discharged from a toner storing member of the toner supply device to the developing roller via the toner supply roller, thereby enabling to form for a long period the resulting image with fine quality.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a toner supply device for use in an image forming apparatus of this invention, for developing an electrostatic latent image formed on an outer peripheral surface of a photosensitive drum by supplying toner thereto and transferring the image developed on the photosensitive drum to a sheet, comprises a toner storing part, a toner supply roller for supplying toner from the toner storing part, a developing roller for supplying toner supplied from the toner supply roller to the electrostatic latent image formed on the photosensitive drum thereby to develop the image, and an L-shaped blade member provided with a contact portion in contact with a surface of the developing roller and an extruding portion formed extruding outward from the contact portion, for regulating a thickness of a toner layer on the developing roller, wherein a length of the extruding portion is determined to 2 mm or less, and a gap formed between the contact portion and an intersection point where an imaginary straight line passing a rotating center of the toner supply roller and the contact portion intersects the surface of the toner supply roller, is determined to 3 mm or more.

According to the above toner supply device in claim 1, the length of the extruding portion of the L-shaped blade member is determined to 2 mm or less and the gap formed between the contact portion at which the blade member comes into contact with the developing roller and an intersecting point of an imaginary straight line connecting the contact portion and the rotating center of the toner supply roller and intersecting the outer peripheral surface of the toner supply roller, namely, between the lower surface of the extruding portion and the outer peripheral surface of the toner supply roller, is determined to 3 mm or more, so that the toner supply path can be formed linearly around the toner supply roller and the developing roller without making a large detour in the side of the developing roller, enabling a smooth flow of toner in the toner supply path and the prevention of clogging therein. It is therefore possible to supply smoothly toner from the toner supply roller to the developing roller and thereby the resultant image excellent in quality can be obtained for a long period.

The toner supply device in claim 2 of the present invention is characterized in that in the toner supply device in claim 1, the toner supply roller and the developing roller are driven to rotate in the same direction. In this way, since the toner supply roller and the developing roller are driven to rotate in the same rotating direction, the flow of toner transported along the toner supply path can be made smooth if a difference of rotary speed between the toner supply roller and the developing roller is determined properly.

The toner supply device in claim 3 of the present invention is further characterized in that, in the toner supply device in claim 1, the length of the extruding portion of the blade member is determined to 1 mm or more to 2 mm or less. The toner supply device in claim 4 of the present invention is characterized in that, in the toner supply device in claim 1, an angle of the L-shaped portion of said blade member is determined in a range of 90° to 95°.

According to the toner supply device in claim 3 and claim 4, the toner supply path can be formed more linearly because the angle of the L-shaped portion of the blade member is determined in a range of 90°–95°, so that the toner flow in the toner supply path can be made smoother without toner clogging therein.

The toner supply device in claim 5 is characterized in that, in the toner supply device in claim 1, it further comprises at least an auger roller arranged near the toner supply roller, the developing roller and the L-shaped blade member, the auger roller forming a toner supply path in cooperation with the toner supply roller, the developing roller and the L-shaped blade member. The toner supply device in claim 6 is further characterized in that, in the toner supply device in claim 5, the auger roller acts for stirring and dispersing the toner in the toner supply path along a direction of a roller shaft thereof.

According to the toner supply device claimed in claims 5 and 6, it is arranged in the toner supply device the auger roller which forms the toner supply path in cooperation with the toner supply roller, the developing roller and the L-shaped blade member and acts for stirring and dispersing the toner in the toner supply path along its roller shaft direction. Therefore, it concludes that the toner in the toner supply path is always retained in flowing state. As a result, it can be formed the toner supply path where the toner can smoothly pass through, without disturbance of toner flow.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of a toner supply device for use in an image forming apparatus, specifically in a laser printer, embodying the present invention will now be given referring to the accompanying drawings.

Figure 1:
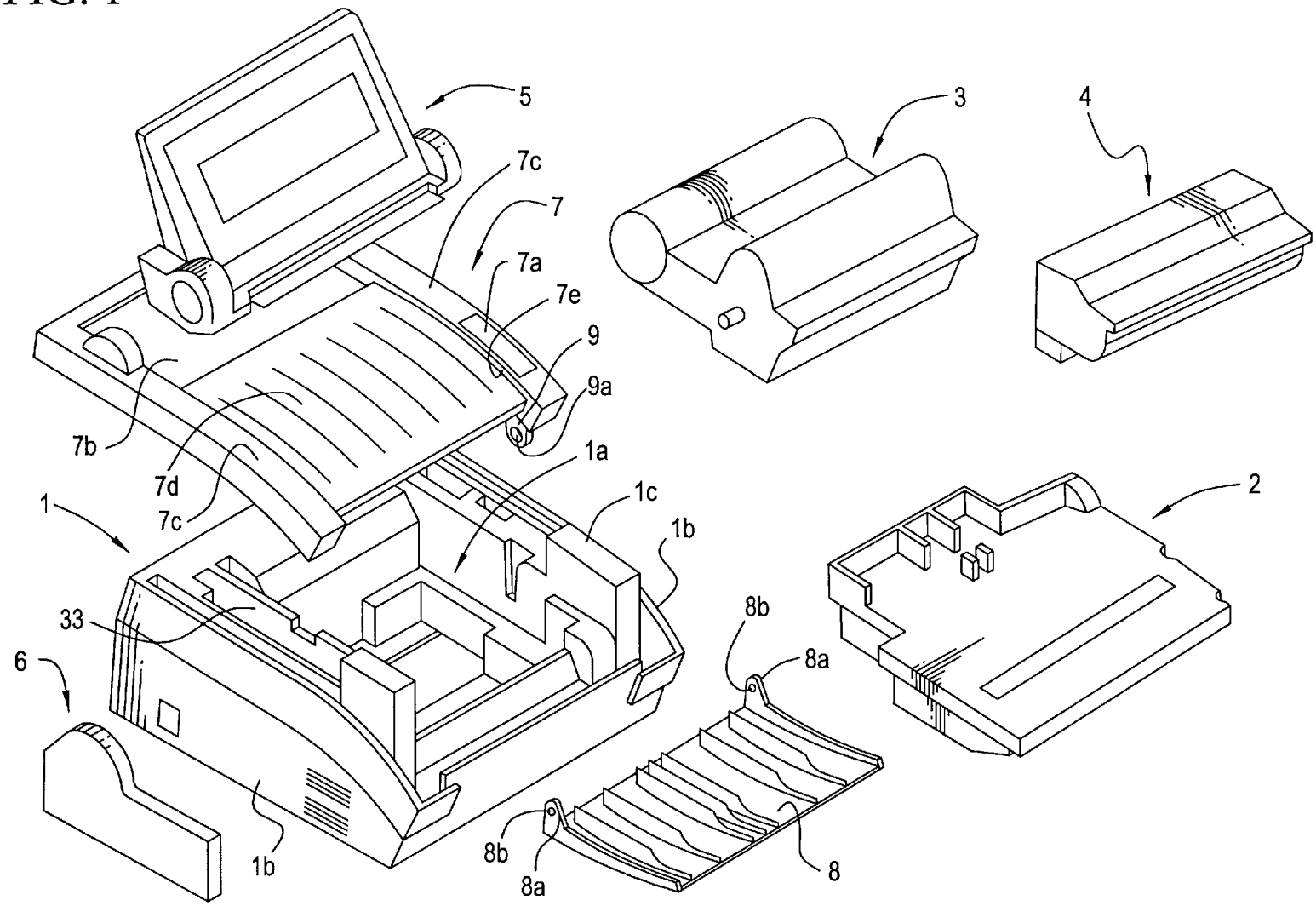
FIG. 1 is a perspective exploded view of main components of a laser printer in an embodiment according to the present invention.
Figure 2:
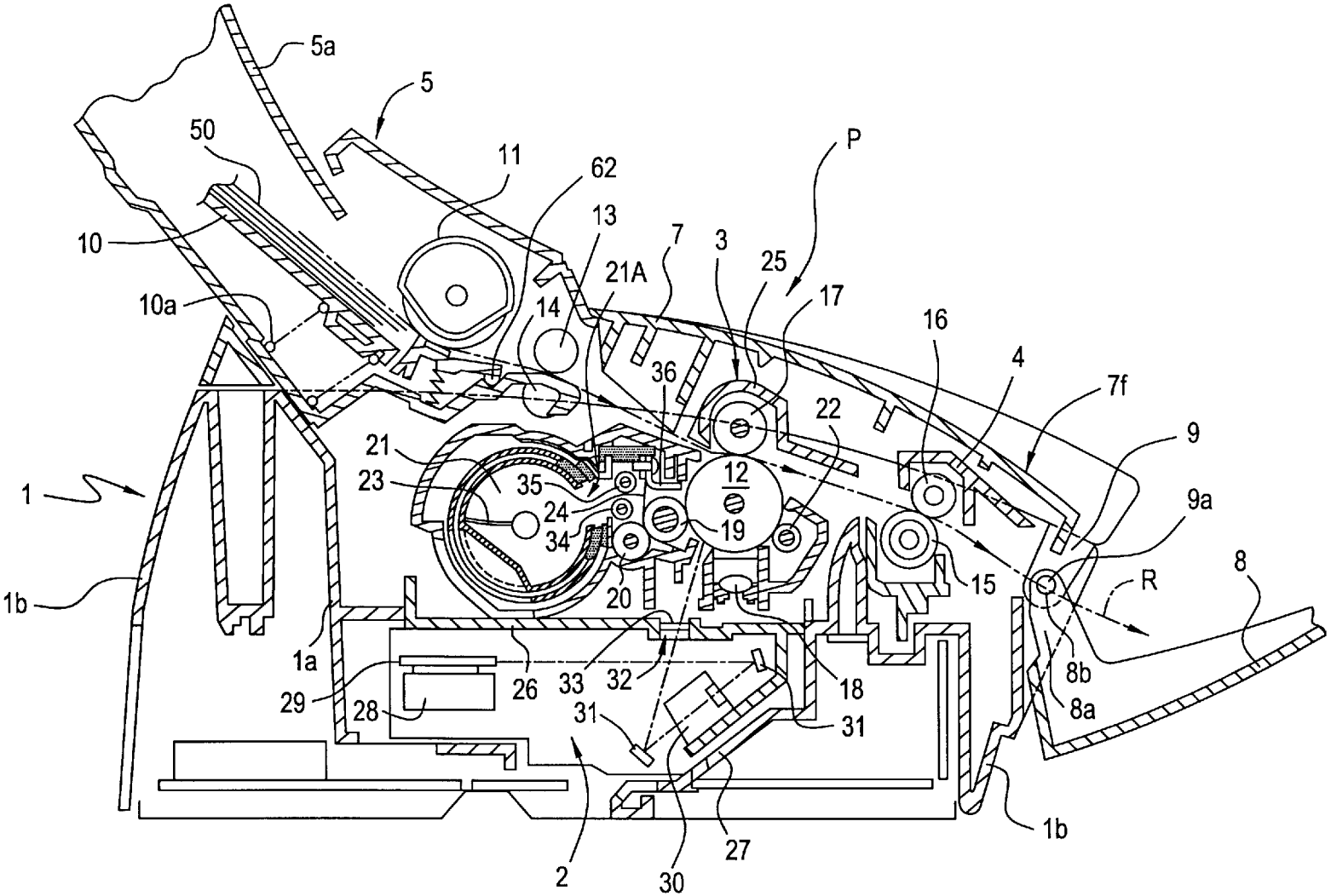
FIG. 2 is a sectional side view of the laser printer of FIG. 1.

First, schematic construction of a laser printer P in an embodiment will be described with reference to FIGS. 1 and 2. FIG. 1 is a perspective exploded view of a main construction of the laser printer P. FIG. 2 is a sectional side view of the laser printer P.

In FIG. 1, a main housing 1 of the laser printer P is formed integrally of a main frame 1*a* and a main cover 1*b* by, for example, an injection molding process. In the main unit 1*a*, set are a scanner unit 2, a process unit 3, a fixing unit 4, and a sheet supply unit 5 from above the main unit 1*a*. The main cover 1*b* serves to cover the outer peripheral four side surfaces, i.e., a fronts back, right, and left sides, of the main frame 1*a*. In a holding recess 33 defined by the outer surface of the main frame 1*a* and inner surface of the main cover 1*b*, a driving system unit 6 including a driving motor and a train of gears is installed and fixed from the lower side of the main housing 1.

The main frame 1*a* is provided with an operational panel 1*c* formed extruding upward. Both upper surfaces of the main frame 1*a* and the main cover 1*b* are covered with an upper cover 7. This upper cover 7 is provided with a hole 7*a* through which the operational panel 1*c* can be inserted and an opening 7*b* through which a base part of the sheet supply unit 5 can be inserted. At both sides in a front side of the upper cover 7 (a right side in FIG. 1), a pair of brackets 9 each having a support shaft 9*a* extruding opposite to each other (only one of them is shown in FIG. 1). A sheet discharge tray 8 is provided with support portions 8*a* formed at both sides thereof and bores 8*b* formed in the support portions 8*a*. Each of the bores can be fitted with each support shaft 9*a* of the brackets 9 so that the sheet discharge tray 8 is supported rotatably with respect to the upper cover 7. On the upper surface of the upper cover 7, there are provided step portions 7*e* between the upper surfaces of side parts 7*c* and the upper surface of a center part 7*d*. Such the step portions 7*e* form a holding recess 7*f* as shown in FIG. 2 for holding the sheet discharge tray 8 in the center part 7*d* of the upper cover 7 during non-use of the tray 8. The sheet discharge tray 8 in non-use can be held in the holding recess 7*f* by turning about the support portions 8*a* so as to be held in the upper cover 7 and, to the contrary, it can be set for use at a position to stack sheets discharged from the fixing unit 4 by turning contrariwise from the holding position to a stack position shown in FIG. 2.

Next, the schematic internal structure of the laser printer P will more detail be explained referring to FIG. 2. In FIG. 2, sheets 50 are held as stacked in a feeder case 5*a* of the sheet supply unit 5. The tip end of each sheet 50 is pressed against a sheet supply roller 11 by a support plate 10 provided with a biasing spring 10*a*, disposed inside the feeder case 5*a*. The sheet supply roller 11 is driven to rotate by a driving power transmitted from the driving system unit 6 and transport individual sheets from the feeder case 5*a* in cooperation with a sheet separating member 62. The sheet 50 separated from the sheet stack is transported to the process unit 3 by means of a pair of resist rollers 13 and 14.

The process unit 3 is a unit to perform a toner development of electrostatic latent image by supplying toner to the electrostatic latent image formed on the peripheral surface of the photosensitive drum 12 by means of a laser optical system, which will be mentioned later, provided in the scanner unit 2 in accordance with image data. More specifically, the process unit 3 is constructed of the photosensitive drum 12 a transfer roller 17 disposed above the photosensitive drum 12 and in contact therewith, a charger 18 such as a Scorotron type of charger, disposed under the photosensitive drum 12, a developing unit including a developing roller 19 disposed upstream of the photosensitive drum 12 in a sheet feeding direction and a toner supply roller 20, a toner cartridge 21 attachably and detachably disposed upstream of the developing unit, which serves as a toner storing unit, and a cleaning roller 22 disposed downstream of the photosensitive drum 12, and other components.

Inside of the developing chamber of the developing unit, a pair of auger rollers, namely, a lower auger roller 34 and an upper auger roller 35, are rotatably provided above the toner supply roller 20. This lower auger roller 34 functions to transport the toner that is supplied from the toner cartridge 21 via a toner supply port 21A into the developing chamber, toward both sides of the toner supply roller 20 above the toner supply roller 20. The toner supply port 21A is constructed of an opening formed in the toner cartridge at an almost center position thereof and an opening formed in a unit frame 25. The upper auger roller 35 functions to transport the toner from the both sides of the toner supply roller 20 toward the toner supply port 21A. In this way, the toner is supplied from the toner supply port 21A to the developing chamber side by means of the upper and lower auger rollers 35 and 34, thereby to circulate above the toner supply roller 20 in the both sides thereof. While circulating, the toner is supplied to and stuck on the toner supply roller 20. The detail structure of each of the lower auger roller 34 and the upper auger roller 35 will be described later.

Above the developing roller 19, a blade 24 is secured with an L-shaped blade fixing element 36 on the lower surface of the unit frame 25. The blade 24 serves to regulate the thickness of a layer of toner supplied on the developing roller 19 from the toner supply roller 20 into a predetermined thickness.

Figure 3:
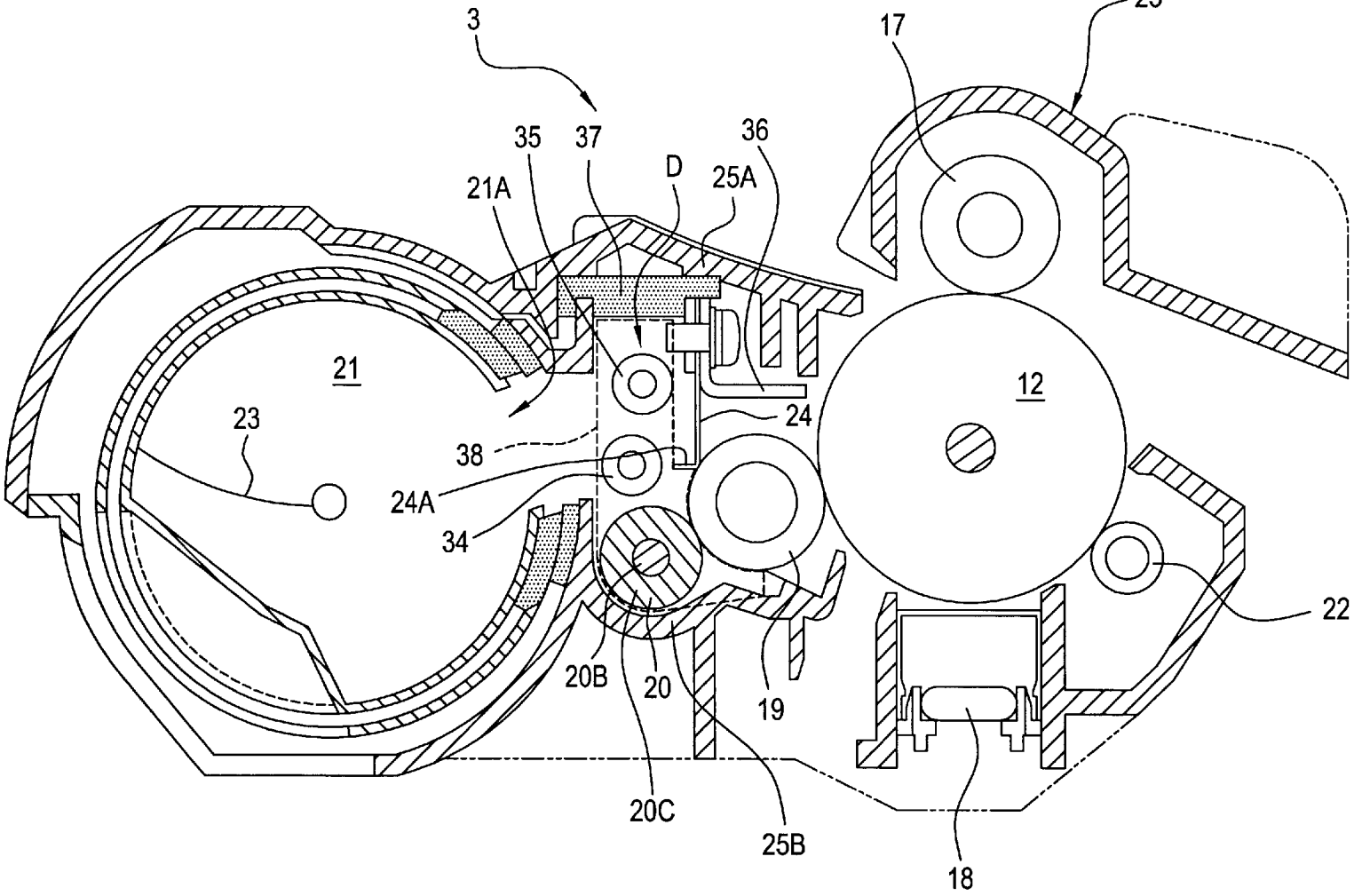
FIG. 3 is a sectional side view of a process unit of the laser printer of FIG. 1.

The blade 24 is also provided with an extruding portion 24A formed extruding outward from the contact portion of the blade 24 with the developing roller 19 as shown in FIG. 3, thereby forming an L-shape.

On the outer peripheral surface of the photosensitive drum 12, an electrically charged layer is formed by the charger 18 and, then, an electrostatic latent image is formed thereon by scanning with a laser beam by means of the scanner unit 2. The toner stored in the toner cartridge 21 is stirred by an agitator 23 thereby to discharge the toner through the toner supply port 21A toward the developing chamber, and is carried on the outer peripheral surface of the developing roller 19 via the toner supply roller 20, where the toner on the developing roller 19 is regulated to form a toner layer having a predetermined thickness by means of the blade 24. When the toner is transported from the developing roller 19 to and stuck on the photosensitive drum 12, the electrostatic latent image formed on the photosensitive drum 12 is visualized and transferred to the sheet 50 passing between the transfer roller 17 and the photosensitive drum 12. The residual toner remaining on the photosensitive drum 12 is transported to the cleaning roller 22.

The process unit 3 constructed above is made as a cartridge type by assembling all components into the unit frame 25 formed of synthetic resin. This cartridge-type process unit 3 is detachably and attachably mounted in the main frame 1*a*.

The scanner unit 2 is provided with a well known laser optical system and makes a scanning on the photosensitive drum 12 by the laser optical system in accordance with predetermined image data, thereby forming an electrostatic latent image on the photosensitive drum 12. More specifically, the scanner unit 2 is arranged under the process unit 3 and a scanner cover 26 is attached on the upper surface of the scanner unit 3. This scanner cover 26 is fixed at the upstream side of a bottom plate 27 of the main frame 1*a*, covering substantially the whole opening of the main frame 1*a*, and is provided with an oblong scanner hole 32 extending along the axis line of the photosensitive drum 12. The scanner unit 2 serving as an exposure unit is provided with a laser emitting element 28, a polygon mirror 29, a lens 30, and a reflecting mirror 31, in which a laser beam can be passed through a glass plate 33 inserted in the oblong scanner hole 32 formed in the scanner cover 26 and emitted to the outer peripheral surface of the photosensitive drum 12 in the process unit 3. Accordingly, the electrostatic latent image is exposed on the outer peripheral surface of the photosensitive drum 12 in accordance with the image data. To the electrostatic latent image formed on the photosensitive drum 12 by the laser optical system of the scanner unit 2 in the above way, the toner is supplied through the process unit 3, performing a toner development of the electrostatic latent image.

The toner developed image based on the electrostatic latent image formed on the photosensitive drum 12 in the process unit 3 is transferred onto the sheet 50 fed to the process unit 3. After that, the sheet 50 is transported to the fixing unit 4 where the toner image transferred onto the sheet 50 is subjected to a heat fixing process by means of a pair of a heat roller 15 and a pressure roller 16. The sheet 50 on which a resultant image (a visual image) is formed is then discharged by the rollers 15 and 16 and stacked onto the sheet discharge tray 8 disposed at a stack position. A path along which the sheet 50 is transported from the sheet supply unit 5 to the sheet discharge tray 8 is indicated by a two-dot chain line R in FIG. 2.

Next, the detail structure of the developing chamber in the process unit 3 will be described with reference to FIG. 3 through FIG. 5 hereinafter. FIG. 3 is a sectional side view of the process unit 3, FIG. 4 is an enlarged view of the developing chamber, and FIG. 5 is a sectional front view of the internal structure of the developing chamber.

Figure 5:
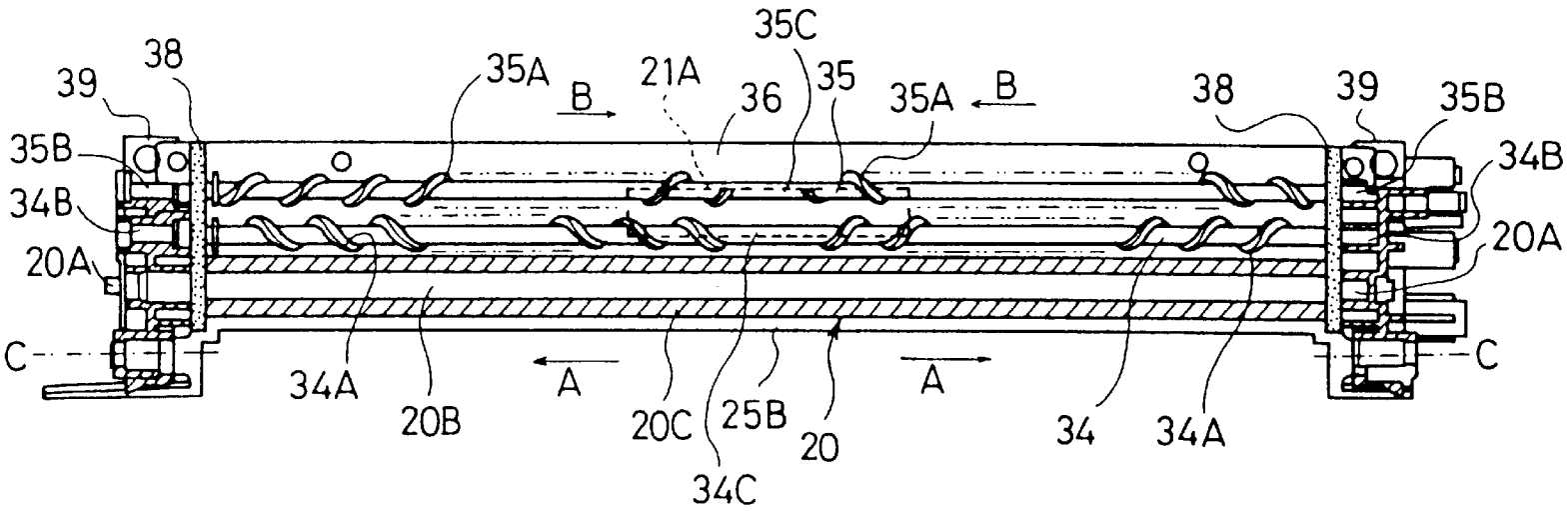
FIG. 5 is a sectional front view showing the internal structure of the developing chamber.

The developing chamber D is a space surrounded by an upper seal member 37 disposed at a lower surface of an upper frame 25A of the unit frame 25, a lower frame 25B of the unit frame 25, and a pair of side seal members 38 shown in FIG. 5 formed of a sponge material, disposed at both sides inside the developing chamber D. The toner supply roller 20 is constructed of a main shaft 203 provided at its both ends with end shafts 20A, and a roller member 20C formed of a sponge material covering the main shaft 203 in its overall length. Each of the end shafts 20A is inserted in a hole of the side seal member 38 and supported at its outer side with each of a pair of support plates 39 attached rotatably to the lower frame 25B.

Meanwhile, the detail construction of the blade 24 and the positional relation between the blade 24 and the toner supply roller 20 will be described in reference to FIG. 4. The structure of the blade is first explained. The length X of the extruding portion 24A is determined to 2 mm or less, preferably in a range of 1 mm to 2 mm. This length X of the extruding portion 24A is an important factor to provide an almost linear toner supply path G around the toner supply roller 20 and the developing roller 19 without interrupting the flow of toner. If the length X of the extruding portion 24A is determined in a range of 1 mm to 2 mm, the toner supply path G is provided in an almost linear path without making a large detour in the developing roller 19 side. This is preferable for manufacturing the blade 24 because it is difficult to manufacture the extruding portion 24A of 1 mm or less. Angle $\alpha$ between the straight portion of the blade 24 secured by the blade fixing member 36 and the extruding portion 24A is determined in a range of 90° to 95°. The angle $\alpha$ is an important factor for forming the toner supply path G as well as the length X of the extruding portion 24A. If the angle a is determined within a range of 90° to 95°, the toner supply path G can be formed as a linear path without preventing the flow of toner.

Figure 4:
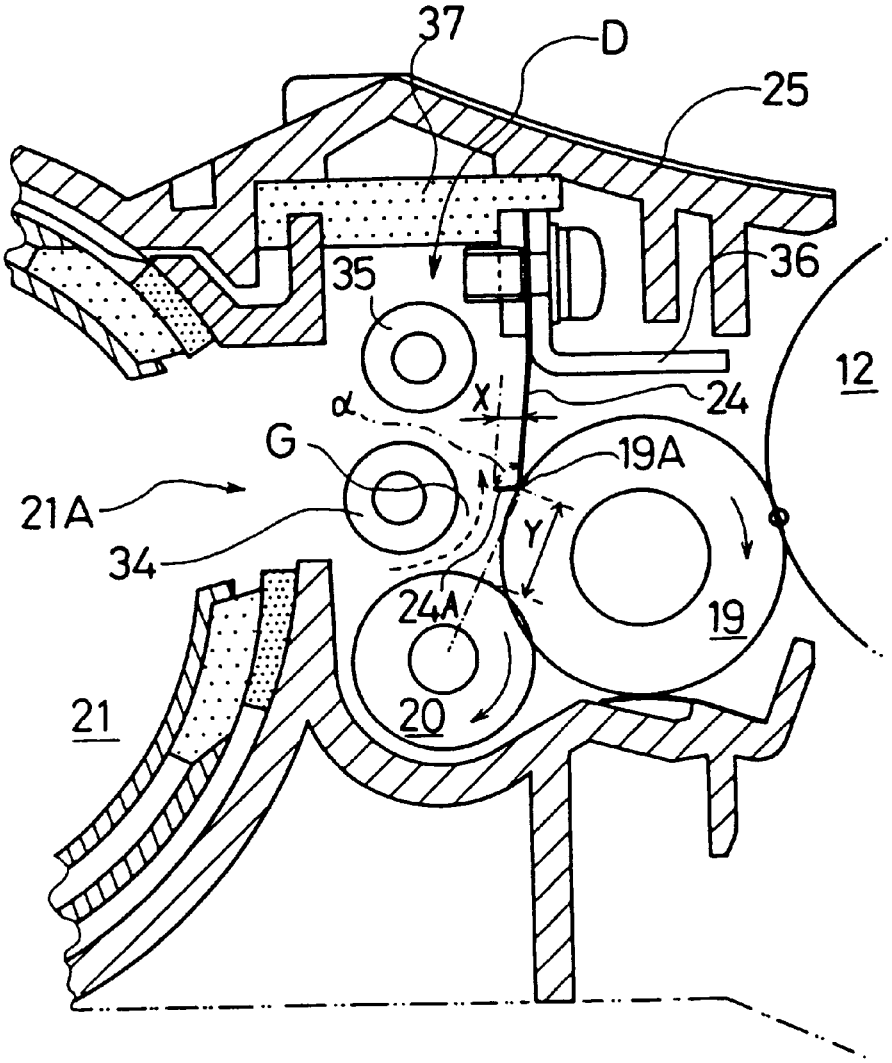
FIG. 4 is a enlarged view of the developing chamber.

In addition, a gap Y is formed between the toner supply roller 20 and the blade 24 and it is defined between a contact portion 19A at which the blade 24 is in contact with the developing roller 19 and a point of intersection of the imaginary straight line connecting the rotating center of the toner supply roller 20 and the contact portion 19A and intersecting the surface of the toner supply roller, as shown in FIG. 4. The gap Y thus formed is an important factor for providing the toner supply path G and is determined to 3 mm or more. When the gap Y is determined to 3 mm or more, in combination of the extruding portion 24A determined in a range of 1 mm to 2 mm, the toner supply path G can be formed more linearly.

The toner supply roller 20 and the developing roller 19 are both driven to rotate clockwise, namely, in the same rotating direction, so that the flow of toner to be transported along the toner supply path G can be made more smoothly if appropriately setting a difference of rotating speed between the toner supply roller 20 and the developing roller 19.

Meanwhile, the rotating center of each support plate 39 is indicated by a dashed line C in FIG. 5. Each support plate 39 also supports rotatably the developing roller 19, so that each support plate 39 is biased in a clockwise direction in FIG. 3 by means of a biasing spring (not shown) to rotate clockwise about the center C, allowing the developing roller 19 to come into contact with the photosensitive drum 12. With each support plate 39, the toner supply roller 20, the upper and lower auger rollers 35 and 34, and the developing roller 19 are supported integrally, making it possible to easily regulate a positional relation among the above components by handling them as a unit and thus to easily conduct the maintenance thereof.

As shown in FIG. 5, further, the lower auger roller 34 in which a center portion 34C thereof is substantially correspondent to a position where the toner supply port 21A is formed (corresponding to a center portion of the toner supply port 21A), is provided with spiral teeth 34A formed spirally extending from the center portion 34C toward opposite ends of the auger roller 34 on the outer surface thereof. A roller shaft 34B of the auger roller 34 is supported at both ends with the supporting plates 39 as well as the toner supply roller 20. When the lower auger roller 34 is rotated clockwise in FIG. 3, accordingly, the toner supplied from the toner supply port 21A is transported successively along the spiral teeth 34A above the toner supply roller 20 toward both ends of the developing chamber D in opposite directions indicated by arrows A. Similarly, a center portion 35C of the upper auger roller 35 is substantially correspondent to a position where the toner supply port 21A is formed (corresponding to a center portion of the toner supply port 21A). The upper auger roller 35 is provided with spiral teeth 35 formed spirally extending from both ends of the auger roller 35 toward the center portion 35C. A roller shaft 35B of the auger roller 35 is supported with the supporting shaft 39 as well as the upper auger roller 34. When the upper auger roller 35 is rotated clockwise in FIG. 3 and the toner transported by the lower auger roller 34 toward the both ends of the developing chamber D is so increased to reach the upper auger roller 35, the toner is transported successively along the spiral teeth 35A in directions indicated by arrows B toward the toner supply port 21A. Thus, a part of the toner is return to the toner cartridge 21 through the toner supply port 21A. In this way, the toner not used for image development is circulated as above and returned to the toner cartridge 21, so that it can prevent toner from remaining in the developing chamber D for a long time. This makes it possible to supply constantly fresh toner from the toner cartridge 21. Even if the toner is not returned to the toner cartridge 21, stirring and circulating by the upper and lower auger rollers 35 and 34 makes toner smoothly flow in the developing chamber D without causing agglomeration of toner.

As mentioned above, each of the upper and lower auger rollers 35 and 34 serves to transport and circulate the toner supplied from the toner supply port 21A into the developing chamber D, above the toner supply roller 20, thereby enabling uniform sticking of toner to all the toner supply roller 20 over without allowing the toner to remain in a limited part. As toner is transported and circulated above the toner supply roller 20 and in its both side directions by means of the upper and lower auger rollers 35 and 34, constantly fresh toner can be stuck on all over the toner supply roller 20, making it possible to supply uniformly toner to the developing roller 19 and the electrostatic latent image formed on the outer peripheral surface of the photosensitive drum 12, thereby to form for a long time the resultant image excellent in quality.

As above, the forming position of the toner supply port 21A in the toner cartridge 21 (a center position of the toner supply port 21A) substantially coincides with the center positions 35C and 34C of the upper and lower auger rollers 35 and 34, so that the toner discharged through the toner supply port 21A can efficiently be transported and circulated above the toner supply roller 20 via the upper and lower auger rollers 35 and 34.

Figure 6:
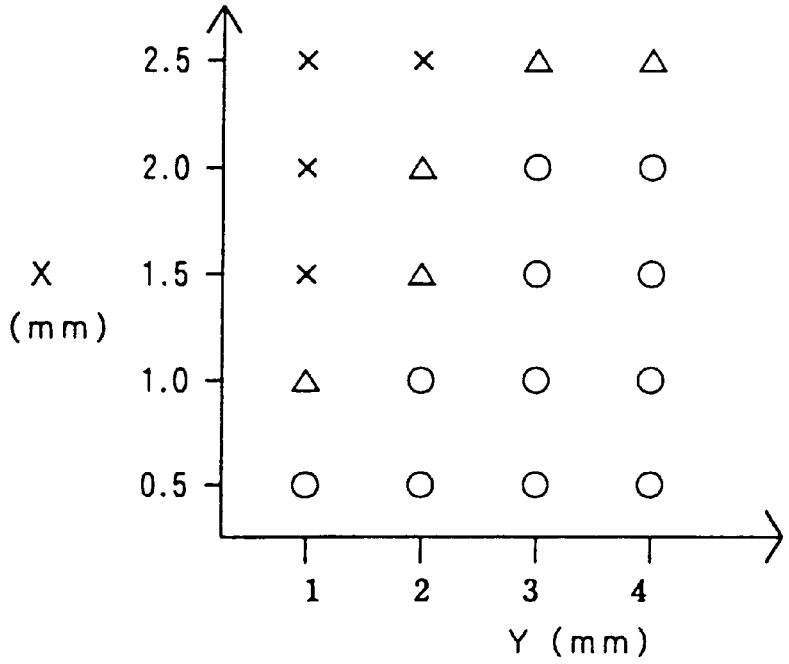
FIG. 6 is a table showing a relation between a length X, a gap Y, and an image quality of the resulting image in variously changing the length X and the gap Y.
Figure 7:
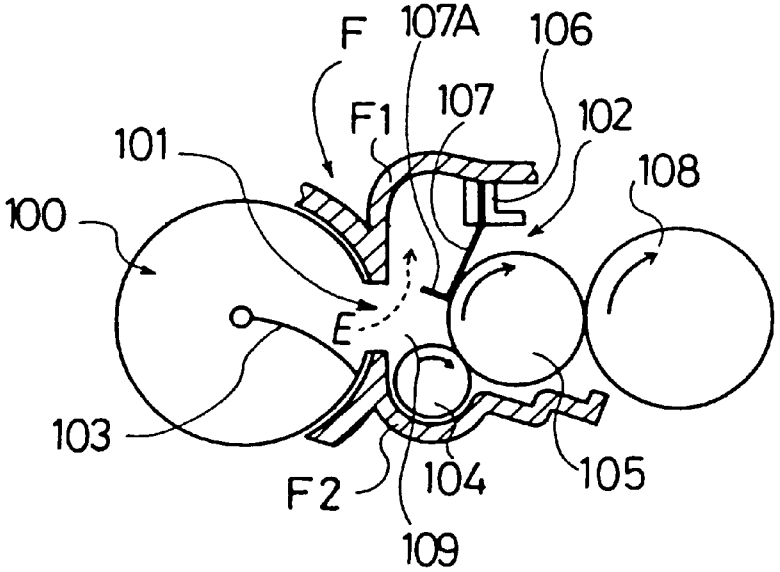
FIG. 7 is an explanatory view schematically showing a main part of a toner supply device in the prior art.

Next, referring to FIG. 6, explained is the influence by variations of the length X and the gap Y on the quality of resultant image in the case that an image forming operation is performed using the toner supply device constructed above while changing the length X of the extruding portion 24A of the blade 24 and the gap Y formed between the lower surface of the extruding portion 24A and the outer surface of the toner supply roller 20. FIG. 6 is a table showing the relation between the length X, the gap Y, and the quality of resultant image in the case that the length X and the gap Y are variously changed where the horizontal axis represents a gap Y (unit: mm) and the vertical axis represents a length X (unit: mm) respectively In the table, "○" means that the resultant image with high quality was obtained without occurring toner clogging in the toner supply path G even after the image forming operation on 10000 or more sheets, "Δ" means that the resultant image deteriorated in quality after the image forming operation on several thousand of sheets though toner clogging has not occurred, and "X" means that toner clogging occurred at an early stage of the image forming operation.

As clearly from FIG. 6, when the gap was 1 mm, there was no toner clogging and deterioration of the quality of resultant image if the length X was 0.5 mm, on the other hand, the quality of resultant image deteriorated although there was no toner clogging if the length X was 1.0 mm. When the length X was 1.5 mm or more, it is found that there occurred toner clogging and deterioration in quality of resultant image. When the gap Y was 2 mm, toner clogging and deterioration in image quality did not occur if the length X of the extruding portion 24A was 1.0 mm or less; however, when the length X was in a range of 1.5 to 2.0 mm, the quality of resultant image deteriorated although no clogging with toner occurred. It is still found that toner clogging and image quality deterioration occurred when the length X is 2.5 mm or more. In the cases that the gap Y was 3 mm and 4 mm, no toner clogging and deterioration in image quality occurred if the length X of the extruding portion 24A was 2.0 mm or less; however, the quality of resultant image deteriorated although no toner clogging occurred if the length X was 2.5 mm or more.

As clearly from above, it is difficult to manufacture the blade 24 with the extruding portion 24A having a length X of 1.0 mm or less, the gap Y is preferably determined to 3 mm or more in consideration of that the length X of the extruding portion 24A is suitably determined in a range of 1 mm to 2 mm.

In the toner supply device in the above embodiment, the length of the extruding portion 24A of the L-shaped blade 24 is determined to 2 mm or less and the distance of the gap Y is determined to 3 mm or more, the gap Y being formed between the contact portion 19A and the intersecting point of the imaginary straight line connecting the rotating center of the toner supply roller 20 and the contact portion 19A at which the blade 24 is in contact with the developing roller 19, intersecting the outer surface of the toner supply roller 20, in other words, between the lower surface of the extruding portion 24A and the outer surface of the toner supply roller 20, so that the toner supply path G provided around the toner supply roller 20 and the developing roller 19 can be formed linearly without making a large detour toward the side of the developing roller 19, thereby allowing the toner to smoothly flow in the toner supply path G and thus preventing the toner supply path G from being clogged with toner. It is therefore possible to supply toner smoothly from the toner supply roller 20 to the developing roller 19 and to form for a long period the resultant image good in quality.

Since both the toner supply roller 20 and the developing roller 19 are driven to rotate in the same direction (in a clockwise direction), a smoother flow of toner along the toner supply path G can be obtained if a difference of rotating speed between the toner supply roller 20 and the developing roller 19 is properly determined.

Further, in the above embodiment, the extruding portion 24A of the blade 24 is determined in a range of 1 mm to 2 mm and the angle $\alpha$ of the extruding portion 24A of the blade 24 is determined in a range of 90° to 95°, that the toner supply path G can be formed linearly, making it possible to make the flow of toner smooth and to prevent clogging in the toner supply path G with toner.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A toner supply device for use in an image forming apparatus for developing an electrostatic latent image formed on an outer peripheral surface of a photosensitive drum by supplying toner thereto and transferring the image developed on the photosensitive drum to a sheet, comprising a toner storing part, a toner supply roller for supplying toner from the toner storing part, a developing roller for supplying toner supplied from the toner supply roller to the electrostatic latent image formed on the photosensitive drum thereby to develop the image, and an L-shaped blade member provided with a contact portion in contact with a surface of the developing roller and an extruding portion formed extruding outward from the contact portion, for regulating a thickness of a toner layer on the developing roller;

wherein a length of said extruding portion is determined to 2 mm or less, and a gap formed between said contact portion and an intersection point where an imaginary straight line passing a rotating center of the toner supply roller and the contact portion intersects the surface of the toner supply roller, is 3 mm to 4 mm.

2. A toner supply device for use in an image forming apparatus according to claim 1, wherein said toner supply roller and said developing roller are driven to rotate in the same direction.

3. A toner supply device for use in an image forming apparatus according to claim 1, wherein the length of the extruding portion of the blade member is determined to 1 mm or more to 2 mm or less.

4. A toner supply device for use in an image forming apparatus according to claim 1, wherein an angle of the L-shaped portion of said blade member is determined in a range of 90° to 95°.

5. A toner supply device for use in an image forming apparatus according to claim 1, further comprising at least an auger roller arranged near the toner supply roller, the developing roller and the L-shaped blade member, the auger roller forming a toner supply path in cooperation with the toner supply roller, the developing roller and the L-shaped blade member.

6. A toner supply device for use in an image forming apparatus according to claim 5, wherein the auger roller acts for stirring and dispersing the toner in the toner supply path along a direction of a roller shaft thereof.

* * * * *